US008322536B2

(12) United States Patent
Rieck

(10) Patent No.: US 8,322,536 B2
(45) Date of Patent: Dec. 4, 2012

(54) COLLAPSIBLE SLUICE BOX

(76) Inventor: Robert Rieck, Santa Ana, CA (US)

( * ) Notice: Subject to any disclaimer, the term of this patent is extended or adjusted under 35 U.S.C. 154(b) by 0 days.

(21) Appl. No.: 13/135,092

(22) Filed: Jun. 24, 2011

(65) Prior Publication Data

US 2012/0000834 A1 Jan. 5, 2012

Related U.S. Application Data

(60) Provisional application No. 61/398,943, filed on Jul. 2, 2010.

(51) Int. Cl.
*B03C 1/30* (2006.01)
*B03B 7/00* (2006.01)

(52) U.S. Cl. ..... 209/421; 209/3; 209/40; 209/44; 209/420

(58) Field of Classification Search ..... 209/3, 40, 209/44, 421, 458, 480, 481, 487
See application file for complete search history.

(56) References Cited

U.S. PATENT DOCUMENTS

| | | | | |
|---|---|---|---|---|
| 185,116 | A | 12/1876 | Mann | |
| 2,923,410 | A | 2/1960 | Tschmelitsch | |
| 3,799,415 | A | 3/1974 | Tidd | |
| 3,897,667 | A * | 8/1975 | Turek | 52/546 |
| 4,142,965 | A | 3/1979 | Dolan | |
| 4,319,985 | A * | 3/1982 | Hibbard | 209/3 |
| 4,375,491 | A * | 3/1983 | Honig | 428/167 |
| 4,592,833 | A * | 6/1986 | Perdue | 209/44 |
| 4,676,891 | A | 6/1987 | Braa et al. | |
| D302,018 | S | 7/1989 | Messenger et al. | |
| 5,785,182 | A | 7/1998 | Ashcraft | |
| 5,927,508 | A * | 7/1999 | Plath | 209/40 |
| 6,065,606 | A | 5/2000 | Bonner | |
| 6,216,367 | B1 * | 4/2001 | Tubbs | 37/314 |
| 6,843,376 | B2 | 1/2005 | Dube et al. | |
| 7,093,719 | B2 | 8/2006 | Roper | |
| 7,461,746 | B1 | 12/2008 | Egge et al. | |
| 2009/0078615 | A1 | 3/2009 | Rainwater et al. | |
| 2012/0000834 | A1 * | 1/2012 | Rieck | 209/44 |

* cited by examiner

*Primary Examiner* — Terrell Matthews
(74) *Attorney, Agent, or Firm* — J. Michael Bak-Boychuk

(57) ABSTRACT

A folding sluice box assembly includes a plurality of generally U-sectioned trough segments having their end portions nested in size progression and hinged to each other to form an overlap of the received portion and the receiving portion. A deformation in the bottom surface of a received portion is aligned on full pivotal extension for mating receipt in a conforming bottom surface opening in the receiving portion, thus interlocking of the assembly into its working configuration. When thus extended the edge of a resilient mat positioned on the bottom surface of the receiving segment abuts the edge of the received segment to effect a substantial seal therewith.

17 Claims, 3 Drawing Sheets

COLLAPSIBLE SLUICE BOX

REFERENCE TO RELATED APPLICATIONS

This application obtains the benefit of the earlier filing date of U.S. Provisional Application Ser. No. 61/398,943 filed on Jul. 2, 2010.

BACKGROUND OF THE INVENTION

1. Field of the Invention

The present invention relates to placer mining devices, and more particularly to a hinged sluice box structure that is collapsible for easy transport to be thereafter erected on site into its operative deployment by interlocks that render this deployment convenient while also minimizing leakage losses of the contained water flow in the course of its use.

2. Description of the Prior Art

The mining of gold or other precious metals aggregated in alluvial deposits, known generally as placer mining, has been practiced by man since the dawn of time, most often by water irrigated methods suggested by the alluvial aggregation itself. While quite effective in using water flow for segregating the heavier precious metal components from the rest of the particulates, these mining processes are heavily dependent on an abundant local water supply which is often affected by local weather patterns, seasonal snow melts and the like that, by way of long term trends, some times cumulatively change a well irrigated landscape into an arid one.

Of course, the random reversals of periodic weather patterns, even those determined by long term trends, are associated with water flows in old, dry stream beds that can serve the mining of old alluvial deposits which were left untouched for some time. This solitude of an arid landscape interrupted by a recent deluge, therefore, is more likely to be productive although usually not well serviced by a network of roads, along with its absence of convenient water flows, reduces the incidence of earlier inspections by others, resulting in a commensurately increased potential of discovery, and a compact, easily transported mining mechanism that recirculates a limited quantity of water is therefore best suited for the search efforts of these more remote sites.

In the recent past the logistic concerns associated with this same solitude have dominated the development focus, resulting in various robust vehicle or trailer borne high volume mining assemblies like those exemplified in U.S. Pat. No. 6,065,606 issued to Bonner; U.S. Pat. No. 6,843,376 issued to Dube et al.; U.S. Pat. No. 7,093,719 issued to Roper, U.S. Pat. No. 7,461,746 issued to Egge et al.; and many others. While suitable for the purposes intended, these robust structures seek to maximize recovery from a site that is already found. Of course, once the prospect of a productive site is known the complement cost and burden of its transport to the remote location become a matter of business accounting, an analytical process that is wholly distinct from the concerns of a remote desert search.

To assist in the successful prospecting of these remote desert areas an effective, highly portable mechanism is required which is easily carried over rough terrain from one alluvial accumulation to another and various examples of such structures have been suggested in the prior asrt exemplified by the teachings of U.S. Pat. No. 3,799,415 to Tidd; U.S. Pat. No. 4,375,491 to Honig; U.S. Pat. No. 4,592,833 to Perdue; U.S. Pat. No. 4,676,891 to Braa et al.; Des. U.S. Pat. No. 302,018 to Messenger et al.; U.S. Pat. No. 5,785,182 to Ashcraft; U.S. Pat. No. 5,927,508 to Plath; and many others. Once again, while each of these prior examples are suitable for their intended purpose, the interests of portability have often dominated the function obtained and functions like process water conservation and its recovery are rarely addressed.

To resolve these concerns I, and thereafter others, have sold to the public folding sluice box assemblies characterized by nested hinged segments which would then be unfolded and secured by fasteners employing wing nuts to fix the unfolded assembly into a common trough within which the alluvial matter is screened and inspected. Examples of these structures were earlier sold by my business Royal Manufacturing Industries, Inc., 600 W. Warner Ave., Santa Ana, Calif. 92707, under model designation 'Stream Sluice' and are currently also sold by JOBE Wholesale, 13911 Pioneer Rd, Apple Valley, Calif. 92307 under model number 6506. Although quite effective as a collapsible sluice structure, these prior sluice arrangements are inherently prone to leakage at each of the hinged, and fastened, folds resulting in unwanted losses of the water stream, and with it also the losses of the heavier matter that may have been collected at the hinge.

Moreover, the inherently imprecise nature of a threaded fastener enabled process has invariably resulted in large overlapping gaps at each hinged joint and the resulting water leakages precluding any realistic conservation of these early water flows and its recirculation. To resolve the foregoing defects I now describe a collapsible sluice structure provided with an inventively improved hinge interlock which effects a tighter panel proximity when deployed to allow for continuous water recovery and recirculation.

SUMMARY OF THE INVENTION

Accordingly it is the general purpose and object of the present invention to provide a closely fitted interlock engagement between U-sectioned trough segments hinged to each other in a nested arrangement.

Other and further objects of the invention shall become apparent from the Inspection of the description that follows in conjunction with the appended illustrations.

Briefly, these and other objects are accomplished within the present invention by providing a set of conformingly nested U-sectioned sheet metal segments hinged in progression to each other at the corresponding overlapped corners of the vertical wall surfaces thereof for pivotal movement from a folded transport arrangement to define a common sluice trough interior upon the unfolding thereof. When thus unfolded a set of inventive conformingly mated interlocks in the overlapped bottom surface edges of each of the segments are engaged to each other, retaining the structure in its deployed form in a closely matched edge overlap that minimises leakage of any water flow conveyed through the common trough.

One, of course, would align the trough inclination so that the water flow therethrough descends from the smaller segment into the next larger segment that it is nested in, and so on, with the dimensional increments between each segment and the next determined by the sheet metal thickness thereof, while the axes of the common hinge pivots are each located for close contact of the overlapped bottom surface edges once deployed. As result a well defined edge overlap is obtained by the dimensions of each segment and their pivot axes so that a sawtooth shaped, raised deformation in the upper edge span of the smaller segment can be pivotally advanced to pass, with the aid of panel flexure, into an interlocking engagement within a conformingly shaped opening in the overlapped bottom surface edge of the bottom surface of the next larger segment. Of course, this interlock can then be conveniently released by applying manual force to produce similar panel flexing, allowing the collapse the assembly for transport.

It will be appreciated that this closely fitted arrangement of overlapped edges and the mated fit of the interlock will limit the leakage of any water flows contained in the common trough interior. Accordingly, the deployed structure can then be combined with a water conserving loop returning some of the local water into a catch basin under the outlet end of the trough to a fitted header mounted on the inlet of the smallest segment. Moreover, since the interlock engagement fixes longitudinal dimension of the edge overlap a precise positioning of a set of conformingly sized mats can be made within each segment so that upon deployment their edges abut each other at the joint both to further seal off any unwanted water loss and to maximize the area for the capture the heavier particulates carried by the water stream. This same mat positioning can then be fixed by known other hardware such as screenings and/or riffling that is useful in controlling the water flow patterns. In this manner a conveniently transported, water conserving sluice box assembly is devised in which all the cooperative components are inventively optimized for the end use intended.

DESCRIPTION OF THE PREFERRED EMBODIMENT

Figure 1:
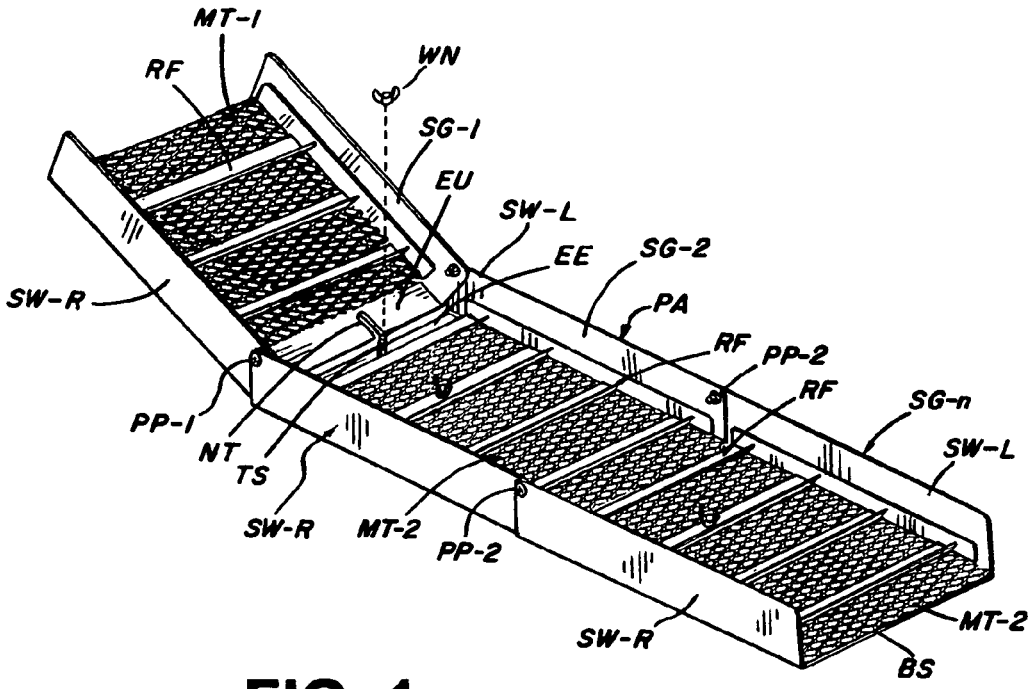
FIG. 1 PRIOR ART
FIG. 1 is a perspective illustration of a prior art sluice box assembly in its articulated form in the course of deployment.
Figure 5:
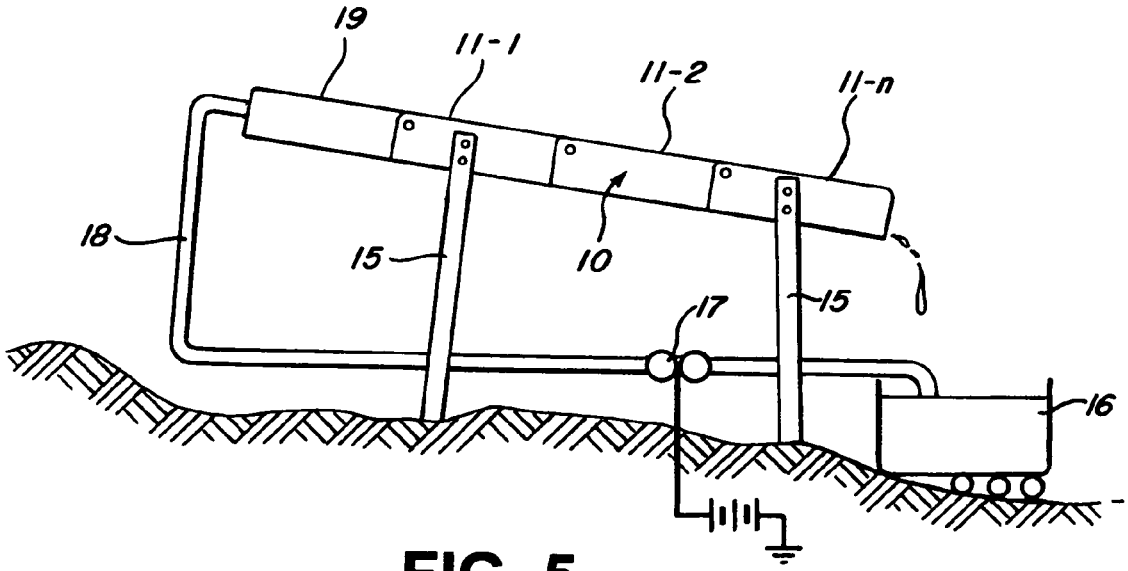
FIG. 5 is a diagrammatic illustration of the inventive collapsible sluice box in the course of its deployed use.
Figure 2:
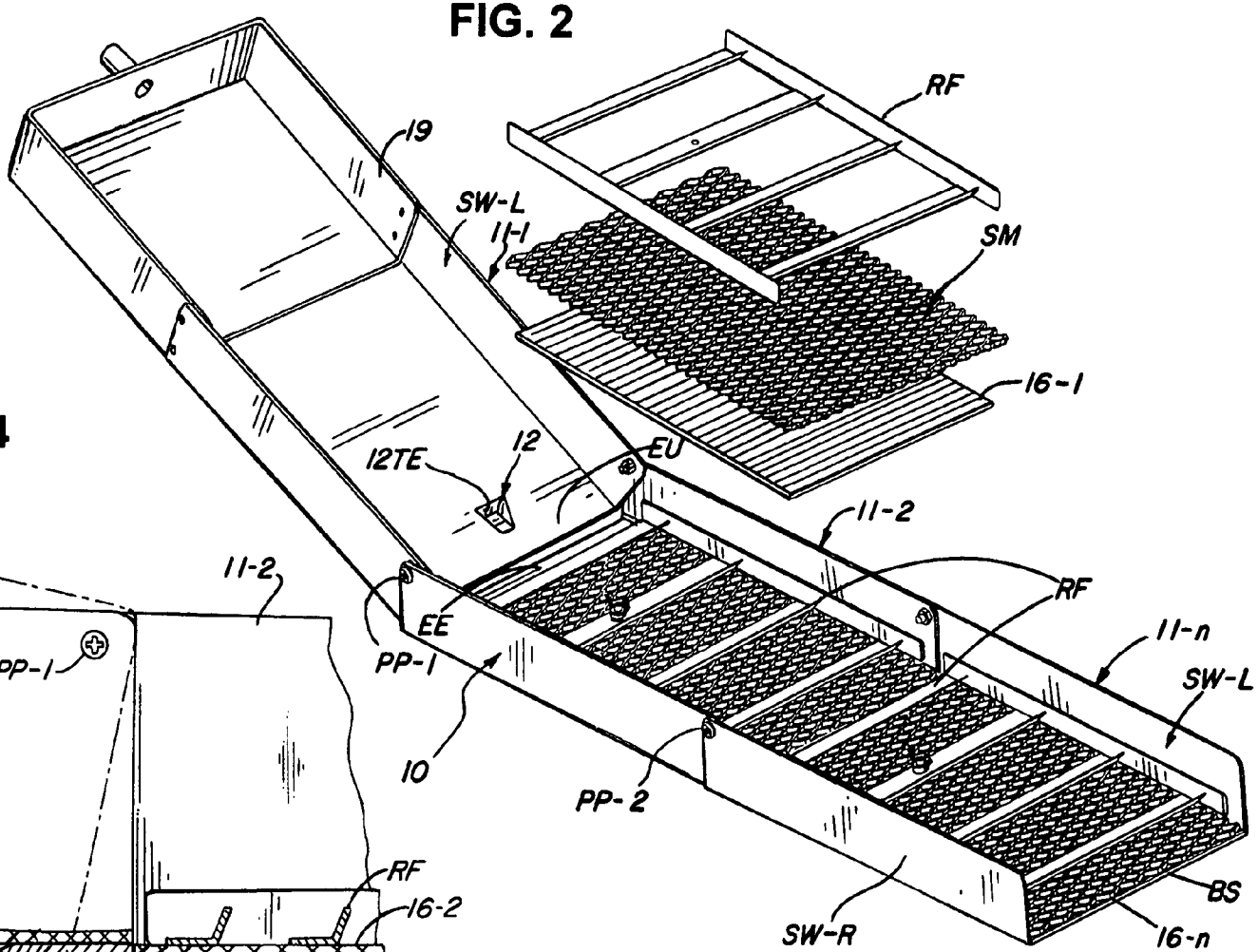
FIG. 2 is yet another perspective illustration depicting the inventive collapsible sluice box assembly in its fully deployed form.
Figure 4:
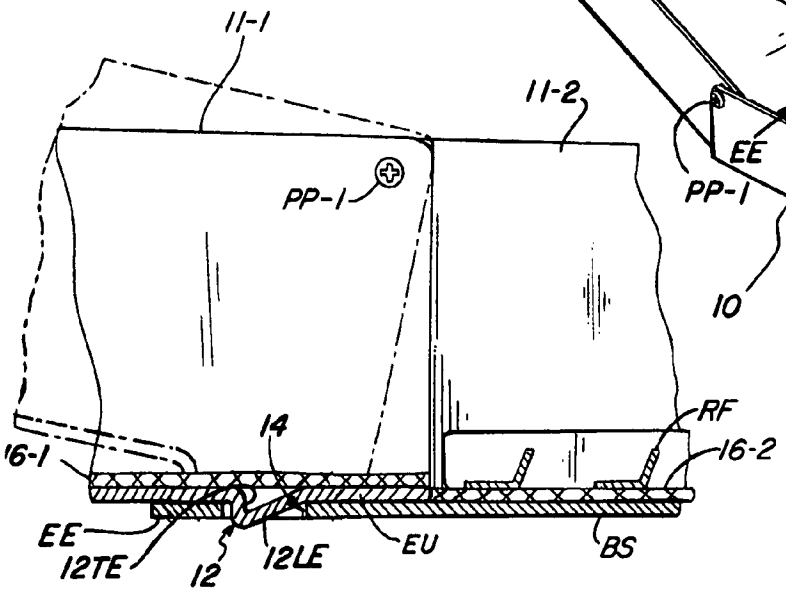
FIG. 4 is a side view, in section, of the inventive collapsible sluice box taken along line 4-4 of FIG. 3.
Figure 3:
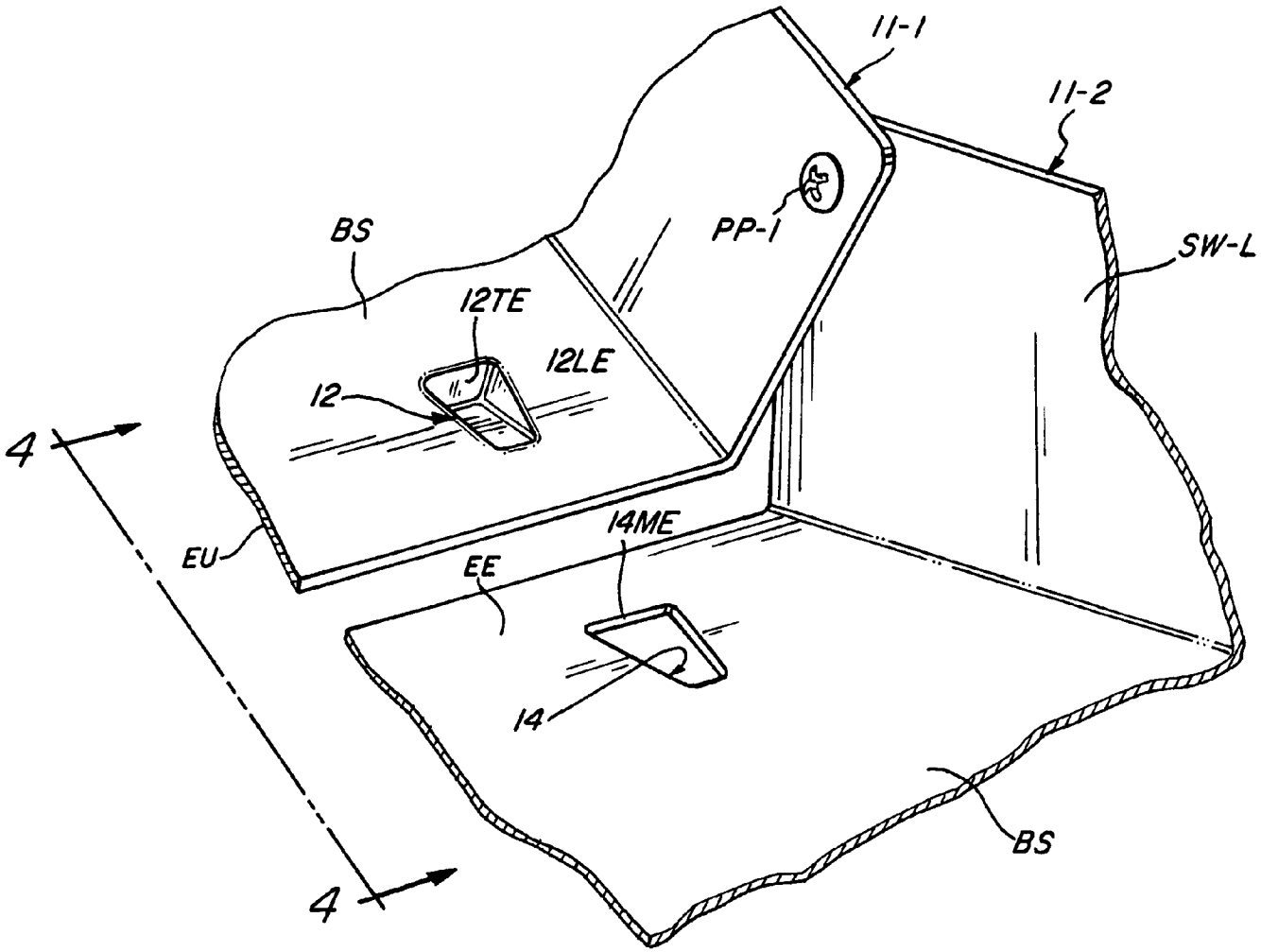
FIG. 3 is a detail illustration, in perspective, depicting a hinge structure at one point of its articulation during the deployment of the inventive collapsible sluice box assembly.

As shown in FIG. 1 the typical prior art implementation of a collapsible sluice box assembly PA, as exemplified by the structure sold by JOBE Wholesale under their model number 6506, is generally defined by a set of nested U-sectioned sheet metal segments SG-1, SG-2 through SG-n each including a rectangular bottom surface BS bounded on both its longitudinal edges by a corresponding vertically aligned left and right sidewall SW-L and SW-R. In order to accommodate a nested receipt of one of the segments in the next adjacent one they are each incrementally larger by at least the thickness of the sheet metal stock with one end of the side walls SW-R and SW-L of the first segment SG-1 pinned by pivot pins PP-1 to the correspondingly overlapping edges of the next segment SG-2, with segment SG-2 then pinned by pivot pins PP-2 to the next segment, and so on.

In each instance the pivot axes of pins PP-1, PP-2 through PP-n are separated from the corresponding bottom surfaces BS by a radial dimension sufficient to allow clearance for the end edge EE of the next larger segment, thereby allowing a pivotal deployment sequence of the segments from a nested and folded arrangement useful during transport to an extended alignment in which the end edge EE of segment SG-2, for example, aligns right below the edge underside EU of segment SG-1. Once thus aligned a threaded stud or bolt TS passing through the edge underside EU then passes into a notch or cut-out NT in edge EE to be secured thereat by a wing nut or any other nut WN to fix the two segments in their extended position with the unfolding deployment process then continuing until the last segment SG-n is thus secured to its neighbor. At this point the unfolded structure is then completed into a form useful to process the alluvial particulate matter by receiving conforming fiber mat segments MT-1, MT-2 through MT-n held in place by expanded metal riffling RF and/or steel mesh SM.

Those skilled in the art will appreciate that the foregoing arrangement, while useful in the form illustrated above, presents several undesirable aspects associated with the dimensional imprecision of the point of securement of post ST in the cut-out NT which then requires compensating area reductions of the mats at the juncture leaving portions of the edges EE bare, leakage potential through the gaps in notches NT and also the obstructive projection of the nut NT. By particular reference to FIGS. 2-5 an inventive collapsible sluice box assembly generally designated by the numeral 10 comprising once again a pivotally joined set of nested segments 11-1 through **11-*n*** each of a progressively larger U-shaped section.

Like numbered parts operating in a manner like that earlier described, each of the segments 11-1, 11-2 through **11-*n* are formed as a sheet metal structure defined by a generally rectangular base surface BS bounded along its longitudinal edges by a left and a right side wall SW-L and SW-R defining a sectional dimension that is incrementally larger by the thickness of the sheet from which they are made. The segments are then arranged in a nested progression in which the ends of sidewalls SW-R and SW-L of the first segment 11-1 are pinned by pivot pins PP-1 to the correspondingly overlapping edges of the next segment 11-2, with segment 11-2 then pinned by pivot pins PP-2** to the next segment, and so on, to form a generally continuous interior trough when unfolded to their extended combination.

In this extended alignment the axes of pins PP-1, PP-2 through PP-n, in a manner previously described, are each radially spaced from their corresponding bottom surfaces BS by a radial dimension sufficient to allow the end edge EE of the next larger segment to pass thereover, thereby aligning the end edge EE of segment 11-2, for example, on the exterior of the underside edge EU of segment 11-1. In the course of reaching this alignment a sloped leading edge 12LE of a generally sawtooth shaped and inwardly directed dimple, or stretched metal, deformation 12 formed generally in the middle of the edge surface EU slides on the opposing surface of edge EE, resulting in a mutual deflection of both the edges until it is received in a correspondingly shaped opening 14 in the center of edge EE so that its generally vertical trailing edge 12TE engages and is interlocked with a matching straight edge 14ME in the opening 14.

The resulting interlock then maintains segments 11-1 through **11-*n* generally aligned with each other to form a common trough that may be mounted on support legs 15 engaging selected side walls sloped to align its draining outlet at the free end of the last segment 11-*n* over a water collecting container 16. A set of conforming fiber mats 16-1 through 16-*n* is then received in each segment and removably secured thereat by riffling RF and steel mesh SM in an end-to-end direct contact at each interlocked joint to further limit any water leakage and particulate loss therethrough as a recirculating stream of the water pumped from container 16 by a battery powered pump 17 and conveyed by a flexible hose 18 to a generally rectangular header 19 attached to the free end of segment 11-1**. Once the alluvial particulate matter placed in the common trough is thus inspected and segregated the mats may be released from their bedded placement and further shaken and examined for the heavier content that may be imbedded.

Of course, the various sheet metal edges of the above various components may be rounded both for handling convenience and to minimize any sharp edge contact at the contact points between the articulated pieces allowing for a generally smooth and non-corrosive material selection like aluminum or stainless steel. In this manner a conveniently folded and also conveniently deployed sluice arrangement is provided which in its useful form conserves the water flows entailed in the process, accommodating prospecting exploration in remote and arid areas.

Obviously many modifications and variations of the instant invention can be effected without departing from the spirit of the teachings herein. It is therefore intended that the scope of the invention be determined solely by the claims appended hereto.

I claim:

1. In a collapsible sluice box assembly characterized by a plurality of nested trough segments each defined by an elongate bottom surface bounded on both its longitudinal sides by lateral edge surfaces, each said trough segment being dimensionally conformed for a mating nested receipt within the interior of the next adjacent trough segment, the lateral edge surfaces thereof pivotally connected for an overlapping receipt of the end portions thereof, the improvement comprising:

a deformation formed in the overlapped portion of the bottom surface of said next adjacent trough segment; and an opening formed in the overlapping portion of the bottom surface of the trough segment received in said next adjacent segment conformed for mating receipt of said interiorly directed deformation and for engagement therewith upon receipt therein.

2. In a collapsible sluice box assembly according to claim 1, wherein:

each said bottom and lateral surface comprises a flexible panel.

3. In a collapsible sluice box assembly according to claim 2, wherein:

said deformation is conformed for sliding translation on said overlapping portion into said opening and for engagement therewith upon receipt therein.

4. In a collapsible sluice box assembly according to claim 1, wherein:

each said trough segment comprises a sheet metal structure bent to define said bottom surface and said lateral surfaces.

5. In a collapsible sluice box assembly according to claim 4, wherein:

said deformation is conformed for sliding translation into said opening and for engagement therewith upon receipt therein.

6. In a collapsible sluice box assembly according to claim 5, the improvement further comprising:

a resilient mat positioned on the exposed portion of each said bottom surface extending to abut the edge of the received bottom surface upon the engagement of said deformation in said opening.

7. In a folding sluice box assembly characterized by a plurality of conforming trough segments each defined by a bottom surface bounded along the sides thereof by corresponding lateral surfaces each dimensioned for nested receipt in overlapping progression of the end portions thereof and hinged to each other at the overlapped ends of side panels, the improvement comprising:

a deformation formed in said bottom surface overlapped by the bottom surface of the next progressive trough segment; and an opening formed in said overlapping portion of said bottom surface of said next trough segment conformed for mating receipt of said deformation and for engagement therewith upon receipt therein.

8. In a collapsible sluice box assembly according to claim 7, wherein:

each said trough segment comprises a sheet metal structure bent to define said bottom surface and said lateral surfaces.

9. In a collapsible sluice box assembly according to claim 8, wherein:

said bottom surface is of a substantially rectangular planform.

10. In a collapsible sluice box assembly according to claim 9, wherein:

each said trough segment comprises a sheet metal structure bent to define said bottom surface and said lateral surfaces.

11. In a collapsible sluice box assembly according to claim 10, wherein:

said deformation is conformed for sliding translation along the overlapping portion of said bottom surface along a path aligned for insertion into said opening and for engagement therewith upon said insertion therein.

12. In a collapsible sluice box assembly according to claim 11, wherein:

said deformation is conformed for mating receipt in said opening.

13. In a collapsible sluice box assembly according to claim 12, wherein:

said deformation is conformed to effect a sealing receipt within said opening.

14. In a collapsible sluice box assembly according to claim 13, the improvement further comprising:

a resilient mat positioned on the exposed portion of each said bottom surface and extending to abut the edge of the overlapped bottom surface upon the engagement of said deformation in said opening.

15. In a collapsible sluice box assembly according to claim 14, the improvement further comprising:

an expanded metal rifling panel received in each said trough in an overlying receipt over said resilient mat.

16. In a collapsible sluice box assembly according to claim 7, wherein:

each said overlapped portion of each said trough is dimensioned for substantially sealing receipt within said overlapping portion of the next trough.

17. In a collapsible sluice box assembly according to claim 16, wherein:

said deformation is conformed for sliding translation along the overlapping portion of said bottom surface along a path aligned for insertion into said opening and for engagement therewith upon said insertion therein to effect a sealing receipt within said opening.

* * * * *